US007850447B1

(12) United States Patent
Wylie et al.

(10) Patent No.: US 7,850,447 B1
(45) Date of Patent: Dec. 14, 2010

(54) DUAL DISC ELECTRODE

(75) Inventors: Brian Wylie, Verona, WI (US); Richard Hauser, Brodhead, WI (US); Ben Hanson, Madison, WI (US)

(73) Assignee: Wolf Appliance, Inc., Madison, WI (US)

( * ) Notice: Subject to any disclaimer, the term of this patent is extended or adjusted under 35 U.S.C. 154(b) by 1362 days.

(21) Appl. No.: 11/194,079

(22) Filed: Jul. 29, 2005

Related U.S. Application Data

(60) Provisional application No. 60/592,896, filed on Jul. 30, 2004.

(51) Int. Cl.
*F23Q 3/00* (2006.01)

(52) U.S. Cl. ..... 431/266; 431/264; 313/139; 313/141; 313/631; 313/351; 174/4 R

(58) Field of Classification Search ..... 431/264, 431/266; 313/139, 141, 136, 292, 140, 445, 313/356, 617, 238, 631, 622, 608; 174/2, 174/3, 4 R, 4 C, 152 S, 138 S; 315/35, 36; 361/220, 222; 73/114.19, 114.21
See application file for complete search history.

(56) References Cited

U.S. PATENT DOCUMENTS

| | | | | | |
|---|---|---|---|---|---|
| 47,846 | A | * | 5/1865 | Mitchell | 174/4 R |
| 79,618 | A | * | 7/1868 | Wells | 174/3 |
| 120,251 | A | * | 10/1871 | Demorest | 403/340 |
| 194,220 | A | * | 8/1877 | Chambers | 174/4 R |
| 510,837 | A | * | 12/1893 | Cole | 73/170.05 |
| 784,677 | A | * | 3/1905 | Hindman | 313/125 |
| 888,711 | A | * | 5/1908 | Kantrowitz | 313/127 |
| 936,507 | A | * | 10/1909 | Anderson | 313/129 |
| 1,110,813 | A | * | 9/1914 | Noble | 313/127 |
| 1,111,453 | A | * | 9/1914 | Giles | 361/130 |
| 1,163,272 | A | * | 12/1915 | Simmons | 313/11.5 |
| 1,166,393 | A | * | 12/1915 | Steinberger | 174/140 R |
| 1,225,467 | A | * | 5/1917 | Miller | 174/102 R |

(Continued)

FOREIGN PATENT DOCUMENTS

EP 485088 A1 * 5/1992

(Continued)

OTHER PUBLICATIONS

Tytronics PTY LTD., Application Notes, Measurement of flame current, 1999.

*Primary Examiner*—Carl D Price
(74) *Attorney, Agent, or Firm*—Foley & Lardner LLP

(57) ABSTRACT

A combined igniter and flame sense electrode for a dual stage gas burner that includes a first burner and a second burner is disclosed. The electrode includes a first conductive element mounted on the shaft and positioned closer to the first burner than to the second burner; a second conductive element mounted on the shaft and positioned closer to the second burner than to the first burner; and one or more electrical connectors connected to the conductive elements. An electrode according to the invention can also be used with a single stage gas burner, by placing the first conductive element at the position of high level flame from the burner and by placing the second conductive element at the position of low level flame from the burner. A gas burner assembly incorporating such an electrode, and a gas appliance incorporating such a gas burner assembly, are also disclosed.

41 Claims, 7 Drawing Sheets

U.S. PATENT DOCUMENTS 1,253,587 A * 1/1918 Graham ..... 123/169 MG
1,270,437 A * 6/1918 Reppin ..... 313/123
1,272,954 A * 7/1918 Horning ..... 313/131 R
1,461,300 A * 7/1923 Winchester et al. .. 123/169 MG
1,461,405 A * 7/1923 Solomon ..... 313/123
1,543,628 A * 6/1925 Stover ..... 313/138
1,621,581 A * 3/1927 Clark ..... 313/123
1,660,635 A * 2/1928 Thompson ..... 313/123
1,838,924 A * 12/1931 Fisher ..... 204/569
1,977,552 A * 10/1934 Grayson et al. ..... 236/15 A
2,064,089 A * 12/1936 Stemmeler ..... 313/11.5
2,073,865 A * 3/1937 Bushey ..... 313/122
2,074,637 A * 3/1937 Ballentine ..... 431/78
2,129,472 A * 9/1938 Lysholm et al. ..... 123/305
2,170,497 A 8/1939 Gille
2,241,295 A * 5/1941 Clark ..... 431/266
2,260,399 A * 10/1941 Peters et al. ..... 313/123
2,313,943 A 3/1943 Jones
2,342,842 A * 2/1944 Corbin et al. ..... 445/7
2,379,873 A 7/1945 Lange
2,483,357 A * 9/1949 Winholm ..... 315/52
2,942,135 A * 6/1960 McLaren ..... 313/136
2,963,620 A * 12/1960 Knudson et al. ..... 315/35
3,007,084 A * 10/1961 Thomasian ..... 431/266
3,034,020 A * 5/1962 Benkoczy ..... 361/222
3,312,848 A * 4/1967 Baum ..... 313/11.5
3,343,366 A * 9/1967 Siegler ..... 60/39.827
3,394,285 A * 7/1968 Lindsay ..... 315/58
3,510,716 A * 5/1970 Carter ..... 313/147
3,520,645 A 7/1970 Cotton et al.
3,585,447 A * 6/1971 McLain ..... 361/222
3,614,280 A * 10/1971 Yamaguchi ..... 431/25
3,628,090 A * 12/1971 McLain ..... 361/222
3,902,839 A 9/1975 Matthews
3,956,664 A * 5/1976 Rado et al. ..... 315/58
3,974,412 A * 8/1976 Pratt, Jr. ..... 313/131 R
4,004,562 A * 1/1977 Rado et al. ..... 123/169 MG
4,087,719 A * 5/1978 Pratt, Jr. ..... 315/45
4,113,419 A 9/1978 Cade
4,177,033 A 12/1979 Wallace
4,192,642 A * 3/1980 Lempa ..... 431/263
4,231,732 A 11/1980 Newport, Jr. et al.
4,238,184 A 12/1980 Schilling
4,307,603 A * 12/1981 Dobler et al. ..... 73/35.08
4,308,487 A * 12/1981 Feaster ..... 315/58
4,325,690 A * 4/1982 Hayes ..... 431/78
4,326,843 A * 4/1982 Smith ..... 431/264
4,459,097 A 7/1984 Riordan et al.
4,466,789 A * 8/1984 Riehl ..... 431/264
4,527,085 A * 7/1985 Bohan et al. ..... 313/128
4,533,973 A 8/1985 Kimmel
4,535,380 A 8/1985 Geary
4,622,005 A 11/1986 Kuroda
4,626,196 A * 12/1986 Stohrer, Jr. ..... 431/264
4,695,758 A * 9/1987 Nishida et al. ..... 313/130
4,841,925 A * 6/1989 Ward ..... 123/143 B
4,871,307 A 10/1989 Harris et al.
4,949,705 A * 8/1990 Smith ..... 126/512
5,169,303 A 12/1992 Paluck
5,517,961 A * 5/1996 Ward ..... 123/307
5,731,655 A * 3/1998 Corrado ..... 313/138
5,760,534 A * 6/1998 Bednar et al. ..... 313/141
5,765,542 A * 6/1998 Fey et al. ..... 126/39 E
5,847,492 A * 12/1998 Frantello ..... 313/141
5,927,963 A 7/1999 Wolcott et al.
5,957,679 A 9/1999 Cacciatore
5,984,668 A * 11/1999 Hansen et al. ..... 431/202
6,007,327 A * 12/1999 Morbitzer ..... 431/75
6,048,196 A * 4/2000 Collier et al. ..... 431/264
6,089,856 A 7/2000 Wolcott et al.
6,126,435 A 10/2000 Fredin-Garcia et al.
D435,141 S 12/2000 Reynolds
6,354,830 B1 3/2002 de Nanclares
6,382,961 B2 5/2002 Clifford et al.
6,481,433 B1 11/2002 Schjerven, Sr. et al.
6,531,809 B1 * 3/2003 Benedikt et al. ..... 313/143
6,743,010 B2 6/2004 Bridgeman et al.
7,098,581 B2 * 8/2006 Cleeves ..... 313/123

FOREIGN PATENT DOCUMENTS

EP 873968 A1 * 10/1998
JP 60111817 A * 6/1985
JP 01159985 A * 6/1989

* cited by examiner

DUAL DISC ELECTRODE

CROSS-REFERENCE TO RELATED APPLICATION

This application claims the benefit of provisional application No. 60/592,896 that was filed Jul. 30, 2004, the disclosure of which is incorporated by reference.

FIELD OF THE INVENTION

The present invention relates generally to ignition and flame sensing for a gas burner and, more particularly, to a combined igniter and flame sense electrode that can reliably ignite and sense the presence of flame from both burners of a stacked dual stage gas burner or from a single stage burner able to operate at a high flame level or a low flame level.

BACKGROUND OF THE INVENTION

Many consumers prefer gas cooking appliances over electric cooking appliances for a variety of reasons. For example, the gas flame of a gas cooking appliance can deliver heat nearly immediately, while electric cooking appliances usually require at least some delay to bring a resistive heating element up to operating temperature. A gas flame can also provide better visual feedback regarding temperature and heat delivery during cooking compared to an electric cooking appliance with a resistive heating element. Although either type of cooking appliance can deliver very good performance, many consumers simply prefer gas, especially in the field of premium and high end cooking appliances sold to discerning consumers.

Automatic ignition systems are well known in gas cooking appliances. Early systems that include a continuous pilot flame have largely been replaced with electronic ignition systems. A typical electronic ignition includes a burner electrically connected to ground, and an electrode placed near the burner and electrically connected to a source of relatively high voltage, for example 10-20 kV. The source of relatively high voltage can be, for example, a transformer that receives normal household power (120 VAC or 240 VAC at 60 Hz) and steps that voltage up to produce a relatively high output voltage, for example in the range of 10-20 kv. Because the transformer is typically configured to deliver this relatively high output voltage at a relatively low current, for example in the range of milliamps, the high output voltage generally does not present any unusual hazard.

To provide ignition, this relatively high voltage is applied to the electrode, and the resulting difference in electric potential between the high-voltage electrode and the burner (which is electrically connected to ground) causes a spark to jump the gap between the electrode and the burner. Assuming that gas is flowing from the burner when the spark occurs, the spark thereby ignites the gas to produce a gas flame which will ordinarily continue burning until the flow of gas is stopped.

Automatic flame detection systems are also well known. An automatic flame detection system can be used to automatically shut off the flow of gas to a burner if no flame is present, for example if the ignition system fails initially, or if the flame is accidentally blown out after successful ignition. Instead of stopping the flow of gas, an automatic flame detection system can be used to trigger ignition when gas begins to flow, or to trigger re-ignition after flame loss. An automatic flame detection system can also be used for a combination of these purposes, for example by attempting ignition for a period of time after the gas begins to flow, and then shutting off the flow of gas if ignition is not achieved within some finite period of time.

Many commercial flame detection systems take advantage of electrical properties of the flame, in particular the fact that a flame includes electrically charged particles that can conduct electricity. For example, when a flame produced by a gas burner extends outwardly from the burner to touch at least part of an electrode, the flame forms an electrically conductive path between the burner and the electrode. When the flame goes out, the electrically conductive path between the burner and the electrode disappears. By measuring the presence or absence of the electrically conductive path between the burner and the electrode, the presence or absence of the flame from the burner can be detected.

Systems which utilize a single electrode for flame detection and flame ignition are also known, for example as taught in U.S. Pat. No. 3,614,280.

Because of the wide variety of foods that can be prepared using any cooking appliance, the optimum rate of heat production can also vary widely. For example, to boil a large kettle of water a cook may wish to apply a large quantity of heat to the kettle over a short period of time. In contrast, to melt chocolate or keep a sauce simmering at serving temperature, a cook may wish to apply a relatively low level of heat over a long period of time. Thus, a cook may desire a cooking appliance capable of delivering both low levels of heat over a long period of time, and high levels of heat over a short period of time.

For this reason, both electrical and gas cooking appliances are often provided with a plurality of burners, with each burner specially adapted to provide a low level of heat or a high level of heat. For example, some burners on a gas range ("high output" burners) may be adapted to deliver high levels of heat in a short period of time, for example by including a large number of gas ports of a relatively large size. Other burners ("simmer" or "low output" burners) may be adapted to deliver low levels of heat over a long period of time, for example by including a relatively small number of gas ports of a relatively small size.

In practice, the actual heat output of either a high output burner or a simmer burner can be modulated over a usable range by adjusting the gas flow to the burner. However, the upper and lower limits of the usable range of heat delivery from a particular burner are generally determined by the construction of the burner itself. For example, when the gas ports from a simmer burner are saturated with gas, the resulting heat output represents the maximum heat output that can be produced by a simmer burner of that particular construction. Similarly, when the flow of gas to a high output burner is adjusted downward to reduce the heat output of that burner, a minimum level of gas flow will be reached that will sustain a flame on a high output burner of that construction.

Because of the limited surface area of a typical gas cooking appliance, the total number of burners that can be accommodated on a single cooking appliance is also limited. For example, a typical gas cooking appliance might contain two simmer burners and two high output burners. The mix of simmer burners and high output burners used on a particular gas appliance is preferably chosen to provide the most appropriate set of burners according to the needs of the owner of that appliance.

However, even with a suitable mix of simmer and high output burners on a particular gas cooking appliance, it is sometimes the case that additional simmer burner capacity may be needed when only high output burners are available, or vice versa. For this reason, "dual stage" burners have been developed that include both high output and simmer features, for example as taught by U.S. Pat. No. 6,322,354, which is owned by the assignee of this application.

A typical dual stage gas burner includes a first main burner and a second simmer burner. The main burner and the simmer burner are each typically formed as a ring, with the radius of the main burner somewhat larger than the radius of the simmer burner, and with the main burner stacked on top of the simmer burner (or vice-versa). Combined flame detection and ignition electrodes have been used with dual stage gas burners, however existing electrodes used for this purpose are known to have several practical limitations. One manifestation of these limitations is "nuisance sparking," where initial ignition attempts are repeated unnecessarily when the flame detection circuitry falsely reports that no flame has been ignited when the flame has already been lit.

First, because either the main burner or the simmer burner of a dual stage gas burner can be in use at any given time, a combined flame detection and ignition electrode must be able to sense flame from either the main burner or the simmer burner. To reliably detect the presence of a flame from the main burner, a flame detection electrode should ideally be placed at a location reached by the outer portion of the flame from the main burner. To reliably detect the presence of a flame from the simmer burner, a flame detection electrode should ideally be placed at a location reached by the outer portion of the flame from the simmer burner. Because the flame produced by the main burner is typically much larger than the flame produced by the simmer burner, it has been found that electrode locations that work well in detecting flame from the main burner may not work well in detecting flame from the simmer burner, and vice-versa.

Second, when used with a dual stage burner, a combined flame detection and ignition electrode must be able to ignite gas flowing from either the main burner or the simmer burner. To reliably ignite gas flowing from the main burner, a flame ignition electrode should ideally be placed at a location where the spark from the electrode will pass through the gas flowing from the main burner. To reliably ignite gas flowing from the simmer burner, a flame ignition electrode should ideally be placed at a location where the spark from the electrode will pass through the gas flowing from the simmer burner. Because the main burner and simmer burner are typically stacked on top of each other, it has been found that electrode locations that work well in igniting flame from the main burner may not work well in igniting flame from the simmer burner, and vice-versa.

Thus, finding a location for a conventional flame detection electrode that will reliably detect flame from both the simmer and main burners is problematic. Finding a location for a conventional flame ignition electrode that will reliably ignite both the simmer and main burners is also problematic. These problems are compounded when the same electrode is used both for ignition and for flame detection.

What is needed is a flame detection electrode that can be positioned to reliably detect flame from both the simmer and main burners. What is further needed is a flame ignition electrode that can be positioned to reliably ignite flame from both the simmer and main burners. What is further needed is a combined flame detection and ignition electrode that can be positioned to reliably detect and ignite flame from both the simmer and main burners. What is further needed is a dual stage gas burner system including a flame detection and ignition electrode that will reliably detect and ignite both the simmer and main burners. What is further needed is a gas cooking appliance with a dual stage gas burner system including a flame detection and ignition electrode that will reliably detect and ignite both the simmer and main burners.

SUMMARY OF THE INVENTION

An preferred embodiment of the invention relates to an electrode having a head that include an upper disc made of an electrically conductive material (such as a metal) and having a first radius, a middle section made of an electrically conductive material, and a lower disc made of an electrically conductive material and having a second radius. The upper disc, the middle section, and the lower disc are electrically connected together, for example by a coaxial rod that keeps the three pieces in intimate contact or by soldering, and adapted to be electrically connected to flame sense and ignition circuitry using an electrical connector.

An electrode according to the invention is adapted to be positioned near a dual stage gas burner by selecting the position and radius of the upper disc to reliably ignite and detect flame from the upper burner in a stacked dual stage gas burner, and by selecting the position and radius of the lower disc to reliably ignite and detect flame from the lower burner in a stacked dual stage gas burner.

An electrode according to the invention is adapted to be positioned near a single stage gas burner adapted to operate a minimum flame output or a maximum flame output, by selecting the position and radius of the upper disc to reliably ignite and detect flame from the burner during maximum flame output, and by selecting the position and radius of the lower disc to reliably ignite and detect flame from the burner in a stacked dual stage gas burner during minimum flame output.

A similar electrode to the preferred embodiment of the invention relates to an electrode having an integrally formed head made of an electrically conductive material (such as a metal) that includes an upper disc having a first radius, a middle section, and a lower disc having a second radius. The conductive portions of the head are adapted to be electrically connected to flame sense and/or ignition circuitry using an electrical connector. This electrode according to the invention performs similarly to the preferred embodiment having a conductive head formed of separate pieces, but it can be somewhat more difficult to manufacture.

An alternative embodiment of the invention relates to an electrode having a head that includes an upper disc made of an electrically conductive material (such as a metal) and having a first radius, a middle section made of a non-conductive material (such as a porcelain or ceramic) and a lower disc made of an electrically conductive material and having a second radius. The upper disc and the lower disc are electrically connected together, for example by intimate contact or by soldering, and adapted to be electrically connected to flame sense and ignition circuitry using an electrical connector.

Another embodiment of the invention relates to an electrode having a head that includes an upper disc made of an electrically conductive material, such as a metal, and having a first radius, a middle section made of a non-conductive material, such as a porcelain, and a lower disc made of an electrically conductive material, such as a metal, and having a second radius. The upper disc and the lower disc are electrically isolated from one another. The upper disk is adapted to be electrically connected to a first flame sense and ignition circuitry using a first electrical connector. The lower disk is adapted to be electrically connected to a second flame sense and ignition circuitry using a second electrical connector. An electrode according to this embodiment is adapted to enable the use of independent and separate ignition and flame detection circuitry for the simmer and main burners.

Another aspect of the invention relates to a gas burner system that includes an electrode according to the invention. Yet another aspect of the invention relates to an appliance that includes an electrode according to the invention.

Other principal features and advantages of the invention will become apparent to those skilled in the art upon review of the following drawings, the detailed description, and the appended claims.

BRIEF DESCRIPTION OF THE DRAWINGS

The exemplary embodiments will hereafter be described with reference to the accompanying drawings, wherein like numerals will denote like elements.

DETAILED DESCRIPTION OF THE PREFERRED EMBODIMENTS

Figure 1:
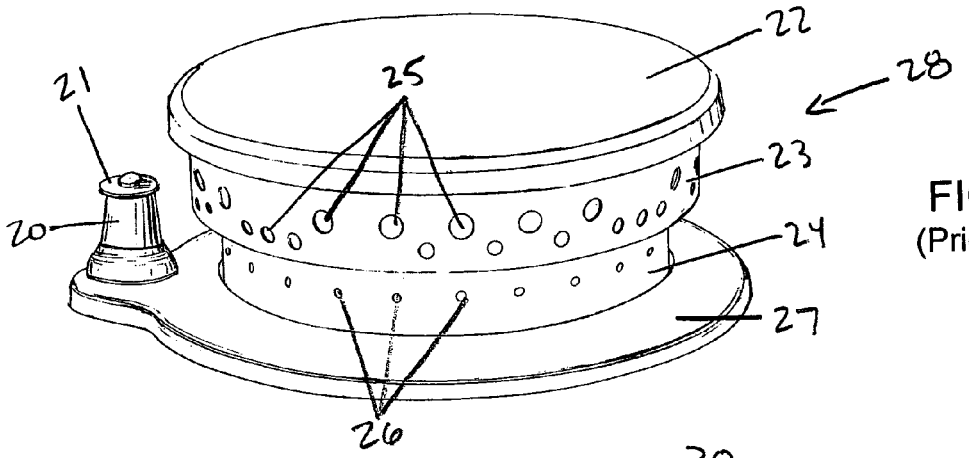
FIG. 1 (Prior Art)
FIG. 1 is a perspective view of a prior art gas burner assembly comprising a prior art combined igniter and flame sense electrode with a dual stage stacked gas burner turned off.
Figure 2:
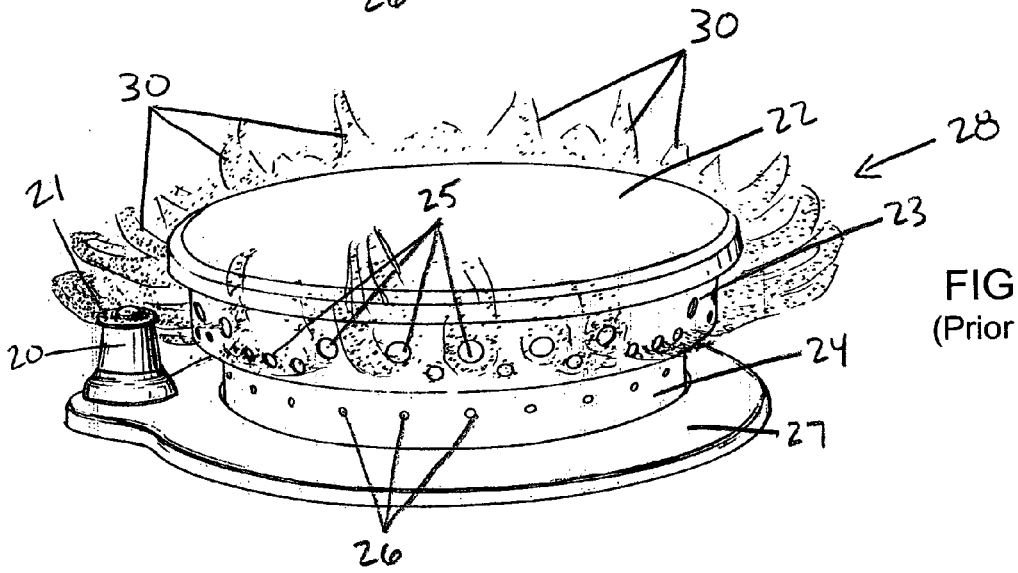
FIG. 2 (Prior Art)
FIG. 2 is a perspective view of the prior art gas burner assembly of FIG. 1 producing a high level flame from the main burner.
Figure 3:
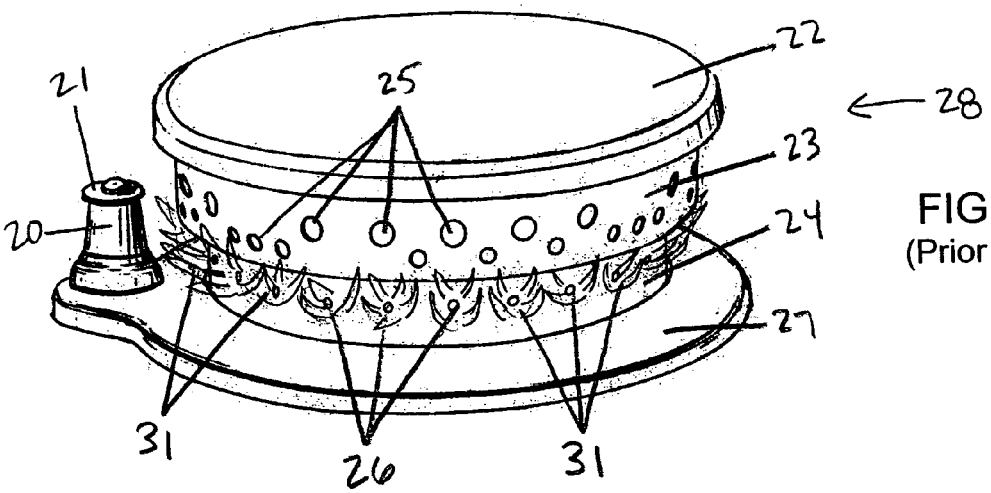
FIG. 3 (Prior Art)
FIG. 3 is a perspective view of the prior art gas burner assembly of FIG. 1 producing a low level flame from the simmer burner.

FIGS. 1-3 show a prior art combined igniter and flame sense electrode, indicated generally at 20, with an exemplary dual stage stacked gas burner, indicated generally at 22, in three different modes of operation. FIG. 1 shows the burner turned off, FIG. 2 shows the burner producing a high level flame 30 from the main burner 23, and FIG. 3 shows the burner producing a low level flame 31 from the simmer burner 24. FIGS. 1-3 are provided to illustrate limitations of such prior art electrodes when used with an exemplary dual stage stacked gas burner. In FIGS. 1-3, the prior art electrode 20 and the exemplary burner 22 are mounted together on a base 27, forming an exemplary prior art burner assembly 28.

The prior art electrode 20 of FIGS. 1-3 includes a disc 21 formed of a conductive metal. Such a prior art electrode 20 can be used for ignition, by grounding the burner 22 and applying a relatively high voltage to the disc 21, so that a spark jumps from a point on the disc 21 that is relatively near to the burner 22 to ignite gas flowing from the burner 22. Such a prior art electrode 20 can also be used to detect flame in the vicinity of the disc 21, by measuring the conductivity between the disc 21 and the burner 22.

The exemplary burner 22 of FIGS. 1-3 includes a main burner 23 stacked on top of a simmer burner 24, where the main burner 23 is adapted for high flame output and the simmer burner 24 is adapted for low flame output. For example, the main burner gas ports 25 may be more numerous and with larger apertures than the simmer burner gas ports 26. In the exemplary burner 22, the main burner 23 and the simmer burner 24 are each formed as a ring, with the radius of the main burner 23 somewhat larger than the radius of the simmer burner 24.

The prior art electrode 20 can have at least two practical limitations when used with a dual stage gas burner, such as the exemplary burner 22. First, the prior art electrode 20 may not reliably detect flame from both the main burner 23 and also from the simmer burner 24. Second, the prior art electrode 20 may not reliably ignite gas from both the main burner 23 and also from the simmer burner 24.

Because either the main burner 23 or the simmer burner 24 of the exemplary burner 22 can be in use at any given time, reliable detection of flame from either the main burner 23 or the simmer burner 24 is required. In order to reliably detect a flame, the disc 21 of the prior art electrode 20 should be positioned so that the flame consistently reaches the immediate vicinity of the disc 21.

FIG. 2 shows the exemplary burner 22 producing a high level flame, indicated generally at 30, from the main burner 23. As shown in FIG. 2, the high level flame 30 extends from the main burner 23 to completely encompass the disc 21 of the prior art electrode 20. For this reason, the prior art electrode 20 should reliably detect a high level flame 30 when the disc 21 of the electrode 20 is positioned horizontally and vertically adjacent to the main burner 23 as shown in FIGS. 1-3.

FIG. 3 shows the exemplary burner 22 producing a low level flame, indicated generally at 31, from the simmer burner 24. In FIG. 3, the low level flame 31 does not extend far enough from the simmer burner 24 to consistently reach the disc 21 of the prior art electrode 20. For this reason, the prior art electrode 20 is unlikely to reliably detect a low level flame 31 when the disc 21 of the electrode 20 is positioned horizontally and vertically relative to the burner 22 as shown in FIGS. 1-3.

It would be possible to reposition the electrode 20 closer to the simmer burner 24 so the low level flame 31 reaches the disc 21 more consistently, to improve reliable detection of the low level flame 31. However, the main burner 23 and the simmer burner 24 are stacked, so the high level flame 30 and the low level flame 31 are produced at different vertical positions relative to the vertical position of the disc 21 of the electrode 20. Similarly, the high level flame 30 extends farther horizontally from the central axis of the burner 22 than the low level flame 31, because the high level flame 30 is larger in volume than the low level flame 31, and/or because the radius of the main burner 23 is larger than the radius of the simmer burner 24.

For these reasons, the best position for the disc 21 of the prior art electrode 20 to detect a high level flame 30 is not the same as the best position to detect a low level flame 31. With the prior art electrode 20, moving the electrode 20 to improve reliable detection of a low level flame 31 would adversely affect reliable detection of a high level flame 30. Depending on the geometry of the burner 22 and on the relative volumes of the high level flame 30 and low level flame 31, it may not be possible to find a position for the prior art electrode 20 that will reliably detect both a high level flame 30 and a low level flame 31.

The prior art electrode 20 has similar problems when used to ignite both a high level flame 30 from the main burner 23 and a low level flame 31 from the simmer burner 24. Because either the main burner 23 or the simmer burner 24 of the exemplary burner 22 can be used at any given time, reliable ignition of gas from either the main burner 23 or the simmer burner 24 is required. To reliably ignite gas flowing from each of the two burners, the electrode 20 should be placed at a horizontal and vertical position so that the spark from the disc 21 will pass through gas flowing from whichever burner is being ignited.

As with flame detection, the optimum positions for ignition of the two different burners differ because of the geometry of the burner 22 and the different gas flow rates of the main burner 23 and the simmer burner 24. As with flame detection, depending on the geometry of the burner 22 and on the relative volumes of the high level flame 30 and low level flame 31, it may not be possible to find a position for the prior art electrode 20 that will reliably ignite both a high level flame 30 from the main burner 23 and a low level flame 31 from the simmer burner 24.

Figure 4:
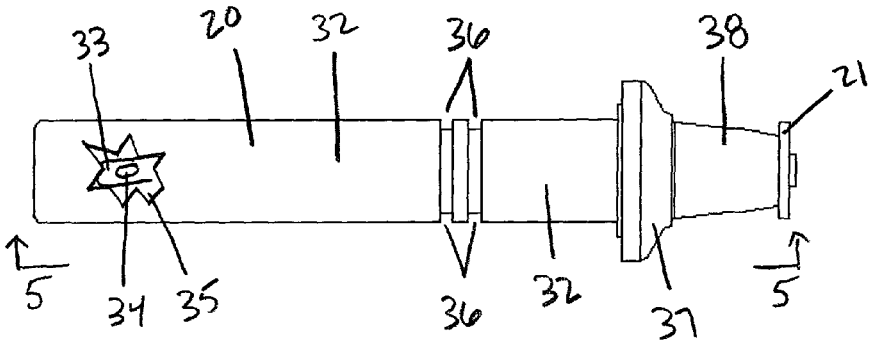
FIG. 4 (Prior Art)
FIG. 4 is a side view of the prior art electrode of FIG. 1.
Figure 5:
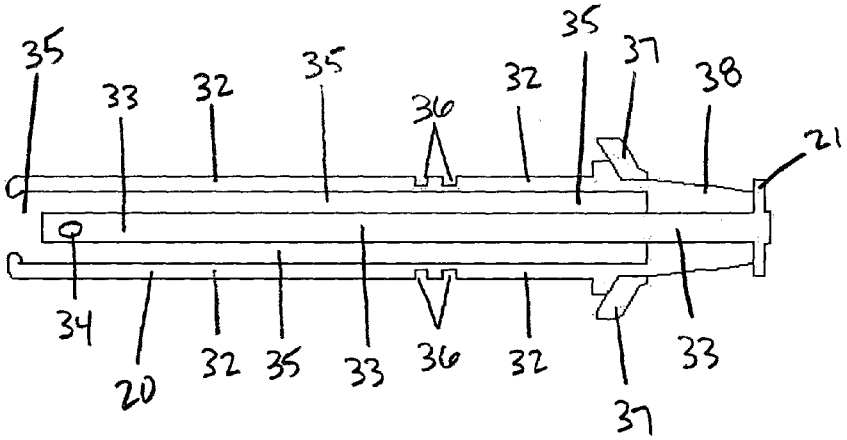
FIG. 5 (Prior Art)
FIG. 5 is a cross-section of the prior art electrode of FIG. 4 taken along the line 5-5 thereof.

FIGS. 4 and 5 provide side and cross-section views, respectively, of the prior art electrode 20 of FIG. 1. The prior art electrode 20 includes a shaft 32 having a first end that terminates in a conductive disc 21. The other end of the shaft 32 is open, allowing access to an electrical connector 33 that is electrically connected, for example by intimate contact or by soldering, to the conductive disc 21. The electrical connector 33 and the conductive disc 21 are formed of an electrically conductive material, such as a metal, that is resistant to heat and corrosion. The electrical connector 33 includes a hole 34 which is adapted to engage a spring loaded pin in a complementary electrical socket (not shown) to form an electrical connection to ignition and/or flame sense circuitry (not shown).

A portion of the shaft 32 is hollow, whereby the shaft 32 surrounds a cylindrical cavity 35, with the electrical connector 33 positioned within the cavity 35. The shaft 32 includes one or more notches 36, which are adapted to engage a spring loaded pin to retain the shaft in a mechanical socket (not shown). The shaft is made of a non-conductive material able to tolerate the high heat levels in the vicinity of a gas flame, such as a ceramic or porcelain material.

The electrode 20 includes a shroud 37, for example to cover the mechanical socket. The shroud 37 is formed of a metal, such as aluminum or stainless steel, that can tolerate high heat and resist corrosion. The shroud 37 is electrically isolated from the electrical connector 33 and the conductive disc 21.

The prior art electrode 20 includes a spacer portion 38 between the shroud 37 and the conductive disc 21. The spacer portion 38 is formed as a portion of the shaft 32, of the same non-conductive and heat-tolerant materials as the rest of the shaft 32.

Figure 6:
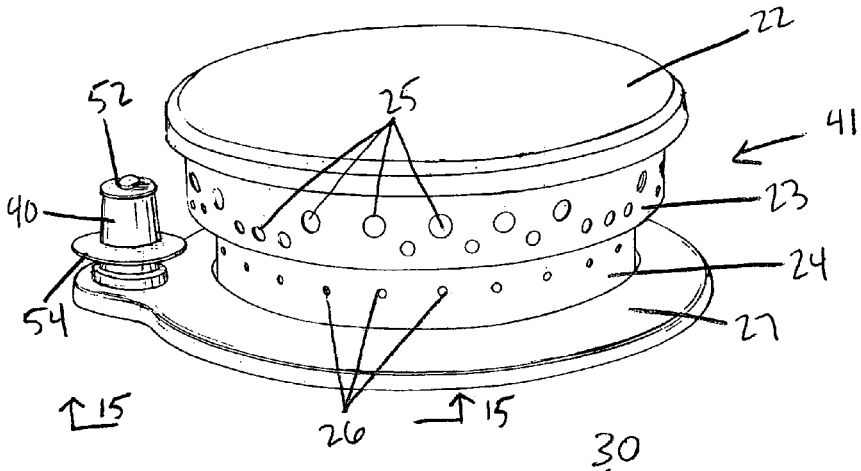
FIG. 6 is a perspective view of a preferred embodiment of a gas burner assembly according to the invention, with a combined igniter and flame sense electrode according to the invention with a dual stage stacked gas burner turned off.
Figure 7:
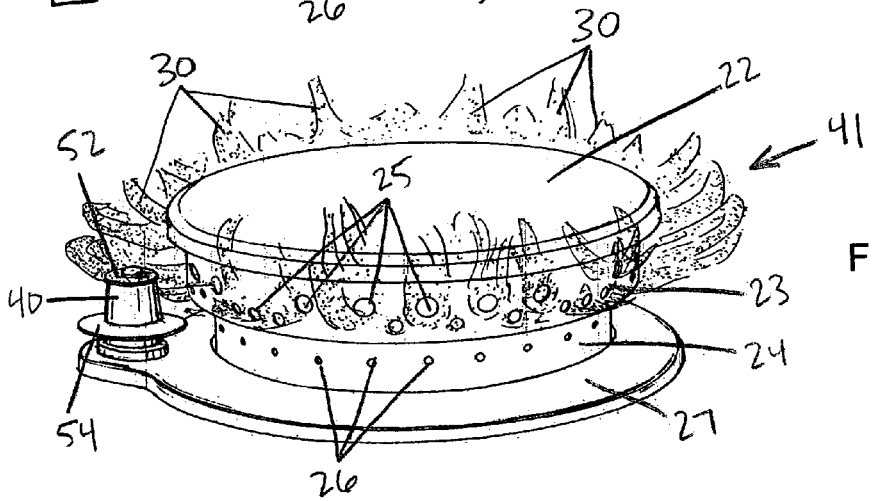
FIG. 7 is a perspective view of the gas burner assembly of FIG. 6 producing a high level flame from the main burner.
Figure 8:
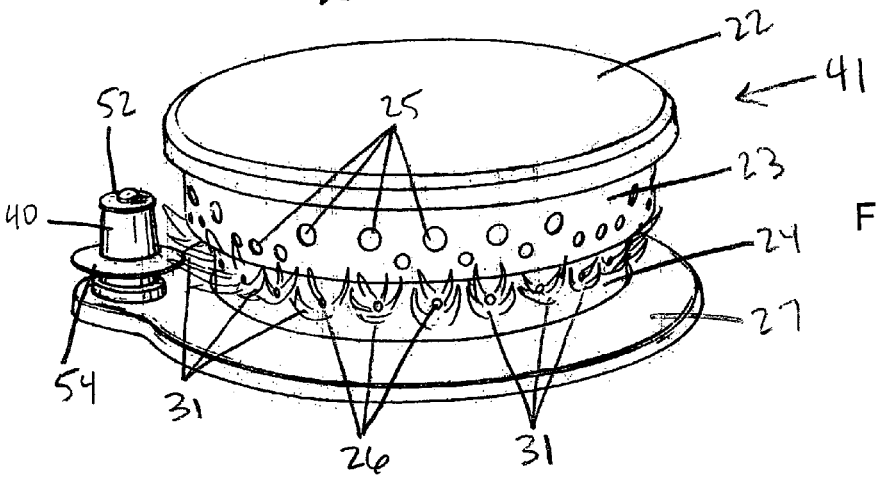
FIG. 8 is a perspective view of the gas burner assembly of FIG. 6 producing a low level flame from the simmer burner.

FIGS. 6-8 show a preferred embodiment of a gas burner assembly 41 according to the invention comprising a combined igniter and flame sense electrode according to the invention, indicated generally at 40, along with an exemplary dual stage stacked gas burner, indicated generally at 22, in three different modes of operation. FIG. 6 shows the burner turned off, FIG. 7 shows the burner producing a high level flame 30 from the main burner 23, and FIG. 8 shows the burner producing a low level flame 31 from the simmer burner 24.

The burner 22 can be, for example, the burner taught in U.S. Pat. No. 6,322,354, owned by the assignee of this application, the contents of which are hereby incorporated by reference. However, this is not required and other dual stage gas burners could be used. For example, a dual stage stacked gas burner where the upper stage is used for low flame output and the lower stage is used for high flame output could be used. Similarly, a dual stage gas burner where the main stage has the same radius, or a smaller radius, than the simmer stage could be used. Also, a dual stage gas burner having a main stage and a simmer stage which are not stacked could be used.

Figure 9:
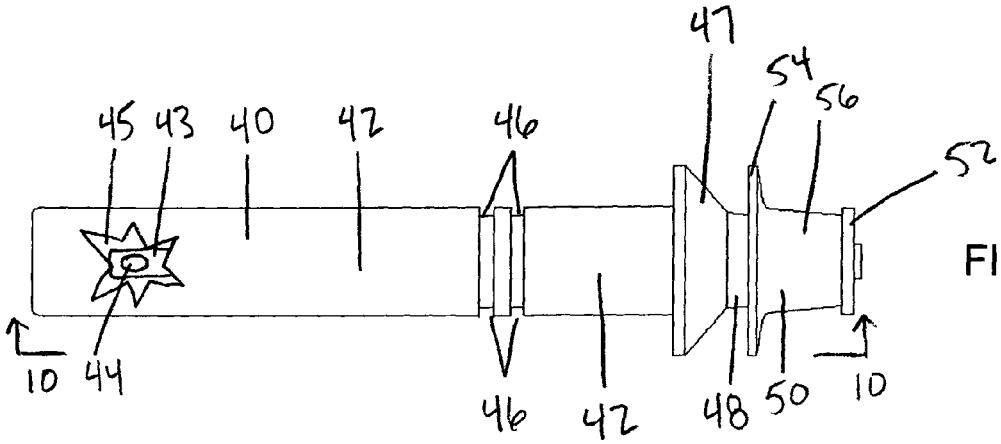
FIG. 9 is a side view of the electrode of FIG. 6.
Figure 10:
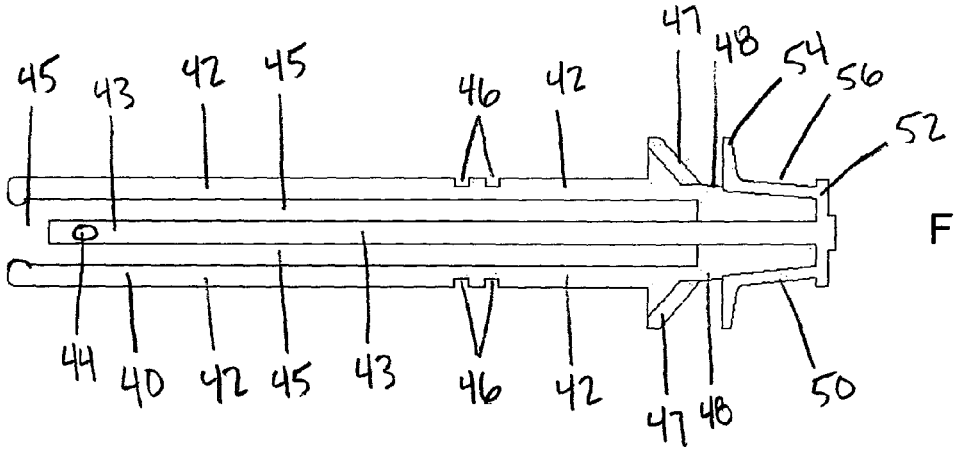
FIG. 10 is a cross-section of the electrode of FIG. 9 taken along the line 10-10 thereof.

FIGS. 9 and 10 provide side and cross-section views, respectively, of the electrode 40 of FIG. 6. The electrode 40 includes a shaft 42 having a first end that terminates in a head, indicated generally at 50, that includes an upper conductive disc 52 and a lower conductive disc 54 surrounding a central portion 56.

In the electrode 40, the upper conductive disc 52, the lower conductive disc 54, and the central portion 56 are electrically connected to each other, for example by intimate contact or by soldering, and formed of an electrically conductive material, such as a metal, preferably one that is resistant to heat and corrosion. The head 50 is preferably formed as an integral piece that includes the upper conductive disc 52, the lower conductive disc 54, and the central portion 56, although this is not required and the head 50 may be formed of separate pieces which are joined together mechanically and electrically.

The upper conductive disc 52 is preferably positioned vertically at approximately the center of the vertical extent of the main (upper) burner 23. The horizontal position and the radius of the upper conductive disc 52 are preferably chosen so that a spark from the upper conductive disc 52 will pass through gas from the main burner ports 25 during ignition, and so that flame from the main burner 23 will consistently reach the immediate vicinity of the upper conductive disc 52. The nearest point of the upper conductive disc 52 is preferably about 2.5-3.0 mm horizontally from the nearest point on the main burner 23.

Similarly, the lower conductive disc 54 is preferably positioned vertically at approximately the center of the vertical extent of the simmer (lower) burner 24. The horizontal position and the radius of the lower conductive disc 54 are preferably chosen so that a spark from the lower conductive disc 54 will pass through gas from the simmer burner ports 26 during ignition, and so that flame from the simmer burner 24 will consistently reach the immediate vicinity of the lower conductive disc 54. The nearest point of the lower conductive disc 54 is preferably about 3.0-3.5 mm horizontally from the nearest point on the simmer burner 24.

Thus, in the electrode 40 for a stacked dual gas burner with the main burner on top of the simmer burner, where the main burner has a larger radius than the simmer burner, the lower conductive disc 54 will generally have a larger diameter than the upper conductive disc 52. It follows that In a similar electrode according to the invention for a stacked dual gas burner with the simmer burner on top of the main burner, where the main burner has a larger radius than the simmer burner, the upper conductive disc 52 will generally have a larger diameter than the lower conductive disc 54.

The other end of the shaft 42 is preferably open, allowing access to an electrical connector 43 that is electrically connected, for example by intimate contact or by soldering, to the upper conductive disc 52, the lower conductive disc 54, and the central portion 56 of the head 50. The electrical connector 43 is formed of an electrically conductive material, such as a metal, preferably one that is resistant to heat and corrosion. The electrical connector 43 preferably includes a hole 44 which is adapted to engage a spring loaded pin in a complementary electrical socket (not shown) to form a secure electrical connection to ignition and/or flame sense circuitry (not shown).

A portion of the shaft 42 is preferably hollow, whereby the shaft 42 surrounds a cylindrical cavity 45, with the electrical connector 43 preferably positioned within the cavity 45. However, this is not required and the shaft 42 may encapsulate a greater or lesser portion of the electrical connector 43, and the electrical connector 43 is not necessarily positioned within the shaft.

The shaft 42 preferably includes one or more notches 46, which are adapted to engage a spring loaded pin to retain the shaft in a mechanical socket (not shown), although this is not required. The shaft 42 is made of a non-conductive material, preferably one able to tolerate the high heat levels in the vicinity of a gas flame, such as a ceramic or porcelain material.

The electrode 40 preferably includes a shroud 47, for example to cover the mechanical socket, although this is not required. The shroud 47 may be formed of a metal, such as aluminum or stainless steel, that can tolerate high heat and resist corrosion. The shroud 47 is preferably electrically isolated from the electrical connector 43 and the upper conductive disc 52, the lower conductive disc 54, and the central portion 56 of the head 50.

The electrode 40 preferably includes a spacer portion 48 between the shroud 47 and the head 50. The spacer portion 48 is preferably formed as an integral portion of the shaft 42, of the same non-conductive and heat-tolerant materials as the shaft 42.

Figure 11:
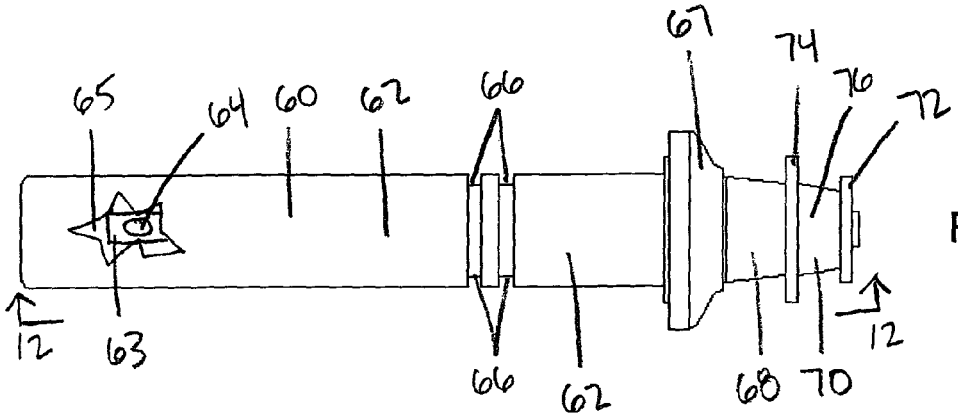
FIG. 11 is a side view of an alternative embodiment of a combined igniter and flame sense electrode according to the invention.
Figure 12:
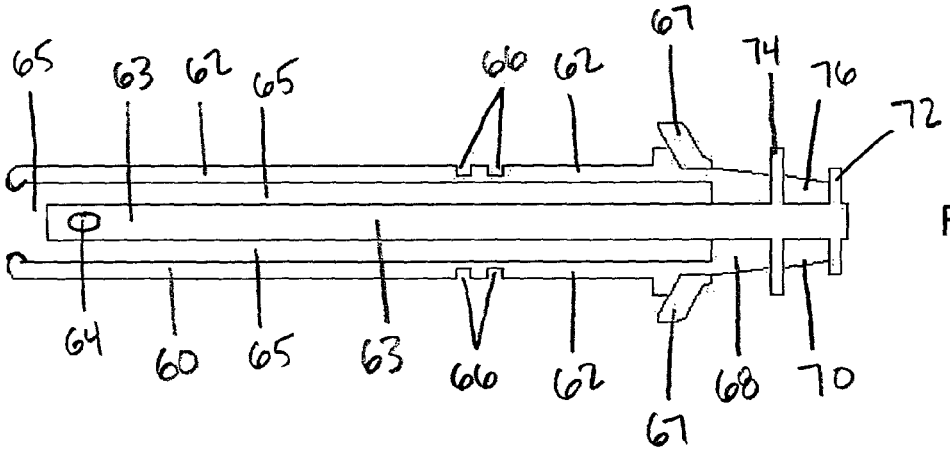
FIG. 12 is a cross-section of the electrode of FIG. 11 taken along the line 12-12 thereof.

FIGS. 11 and 12 provide side and cross-section views, respectively, of an alternative embodiment of a combined igniter and flame sense electrode according to the invention, indicated generally at 60. The electrode 60 includes a shaft 62 having a first end that terminates in a head, indicated generally at 70, that includes an upper conductive disc 72 and a lower conductive disc 74 separated by a central nonconductive portion 76.

In the electrode 60, the upper conductive disc 72 and the lower conductive disc 74 are electrically connected to each other, for example by intimate contact or by soldering, and formed of an electrically conductive material, such as a metal, preferably one that is resistant to heat and corrosion. The central nonconductive portion 76 is formed of a non-conductive material, preferably one that is heat resistant, such as porcelain or ceramic.

Note that the general structure of the head 70 of the electrode 60 could also be used to form an electrode similar to that of FIGS. 9-10 by replacing the non-conductive middle portion 76 with a conductive middle portion. This similar electrode would have electrical properties similar to the electrode of FIGS. 9-10 having an integrally formed conductive head, however this similar electrode could be easier to manufacture.

The upper conductive disc 72 is preferably positioned vertically at approximately the center of the vertical extent of the main (upper) burner. The horizontal position and the radius of the upper conductive disc 72 are preferably chosen so that a spark from the upper conductive disc 72 will pass through gas from the main burner ports 25 during ignition, and so that flame from the main burner will consistently reach the immediate vicinity of the upper conductive disc 72. The nearest point of the upper conductive disc 72 is preferably about 3-3.5 mm horizontally from the nearest point on the main burner 23.

Similarly, the lower conductive disc 74 is preferably positioned vertically at approximately the center of the vertical extent of the simmer (lower) burner. The horizontal position and the radius of the lower conductive disc 74 are preferably chosen so that a spark from the lower conductive disc 74 will pass through gas from the simmer burner ports 26 during ignition, and so that flame from the simmer burner will consistently reach the immediate vicinity of the lower conductive disc 74. The nearest point of the lower conductive disc 74 is preferably about 3-3.5 mm horizontally from the nearest point on the simmer burner 24.

The other end of the shaft 62 is preferably open, allowing access to an electrical connector 63 that is electrically connected, for example by intimate contact or by soldering, to the upper conductive disc 72 and the lower conductive disc 74 of the head 70. The electrical connector 63 is formed of an electrically conductive material, such as a metal, preferably one that is resistant to heat and corrosion. The electrical connector 63 preferably includes a hole 64 which is adapted to engage a spring loaded pin in a complementary electrical socket (not shown) to form a secure electrical connection to ignition and/or flame sense circuitry (not shown).

A portion of the shaft 62 is preferably hollow, whereby the shaft 62 surrounds a cylindrical cavity 65, with the electrical connector 63 preferably positioned within the cavity 65. However, this is not required and the shaft 62 may encapsulate a greater or lesser amount of the electrical connector 63, and the electrical connector 63 is not necessarily positioned partially or completely inside the shaft.

The shaft 62 preferably includes one or more notches 66, which are adapted to engage a spring loaded pin to retain the shaft in a mechanical socket (not shown), although this is not required. The shaft 62 is made of a non-conductive material, preferably a material able to tolerate the high heat levels in the vicinity of a gas flame, such as a ceramic or porcelain material.

The electrode 60 preferably includes a shroud 67, for example to cover the mechanical socket, although this is not required. The shroud 67 may be formed of a metal, such as aluminum or stainless steel, that can tolerate heat and resist corrosion. The shroud 67 is preferably electrically isolated from the electrical connector 63 and the upper conductive disc 72 and lower conductive disc 74 of the head 70.

The electrode 60 preferably includes a spacer portion 68 between the shroud 67 and the lower conductive disc 74 of the head 70. The spacer portion 68 is preferably formed as an integral portion of the shaft 62, of the same non-conductive and heat-tolerant materials as the shaft 62.

Figure 13:
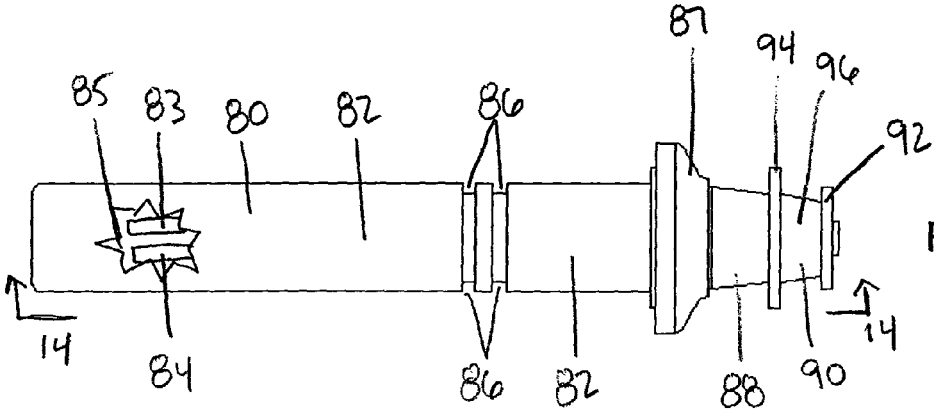
FIG. 13 is a side view of another embodiment of a combined igniter and flame sense electrode according to the invention.
Figure 14:
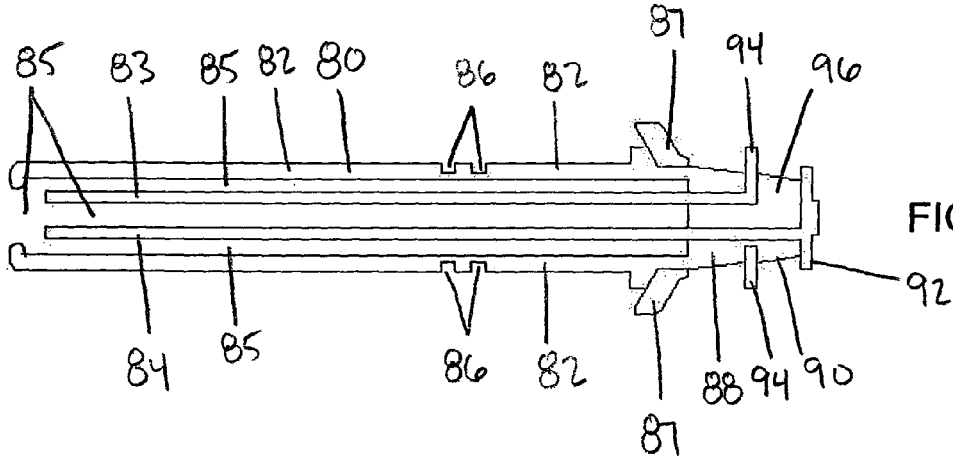
FIG. 14 is a cross-section of the electrode of FIG. 13 taken along the line 14-14 thereof.

FIGS. 13 and 14 provide side and cross-section views, respectively, of another embodiment of a combined igniter and flame sense electrode according to the invention, indicated generally at 80. The electrode 80 includes a shaft 82 having a first end that terminates in a head, indicated generally at 90, that includes an upper conductive disc 92 and a lower conductive disc 94 separated by a central nonconductive portion 96.

In the electrode 80, the upper conductive disc 92 is electrically connected to a first electrical connector 84. The lower conductive disc 94 is electrically connected to a second electrical connector 83. The upper conductive disc 92 and the lower conductive disc 94 are electrically isolated from each other. It follows that the electrode 80 can enable the use of separate circuitry for flame sensing and ignition for the main burner and simmer burner, if necessary or desirable in a particular application.

In the electrode 80, the upper conductive disc 92 and the lower conductive disc 94 are each formed of an electrically conductive material, such as a metal, preferably one that is resistant to heat and corrosion. The central nonconductive portion 96 is formed of a non-conductive material, preferably a heat resistant material such as porcelain or ceramic.

The upper conductive disc 92 is preferably positioned vertically at approximately the center of the vertical extent of the main (upper) burner. The horizontal position and the radius of the upper conductive disc 92 are preferably chosen so that a spark from the upper conductive disc 92 will pass through gas from the main burner ports 25 during ignition, and so that flame from the main burner will consistently reach the immediate vicinity of the upper conductive disc 92. The nearest point of the upper conductive disc 92 is preferably about 3-3.5 mm horizontally from the nearest point on the main burner 23.

Similarly, the lower conductive disc 94 is preferably positioned vertically at approximately the center of the vertical extent of the simmer (lower) burner. The horizontal position and the radius of the lower conductive disc 94 are preferably chosen so that a spark from the lower conductive disc 94 will pass through gas from the simmer burner ports 26 during ignition, and so that flame from the simmer burner will consistently reach the immediate vicinity of the lower conductive disc 94. The nearest point of the lower conductive disc 94 is preferably about 3-3.5 mm horizontally from the nearest point on the simmer burner 24.

The other end of the shaft 82 is preferably open, allowing access to the first electrical connector 84 that is electrically connected to the upper conductive disc 92, and also access to the second electrical connector 83 that is electrically connected to the lower conductive disc 94 of the head 90. The first electrical connector 84 and the second electrical connector 83 are electrically isolated from each other, and each is formed of an electrically conductive material, such as a metal, preferably one that is resistant to heat and corrosion. Each electrical connector may include a hole (not shown) adapted to engage a spring loaded pin in a complementary electrical socket to form a secure electrical connection to ignition and/or flame sense circuitry.

A portion of the shaft 82 is preferably hollow, whereby the shaft 82 surrounds a cylindrical cavity 85, with the first electrical connector 84 and the second electrical connector 83 preferably positioned within the cavity 85. However, this is not required and the shaft 82 may encapsulate a greater or lesser amount of the electrical connectors, and the electrical connectors are not necessarily positioned partially or completely inside the shaft.

The shaft 82 preferably includes one or more notches 86, which are adapted to engage a spring loaded pin to retain the shaft in a mechanical socket (not shown), although this is not required. The shaft 82 is preferably made of a non-conductive material able to tolerate the high heat levels in the vicinity of a gas flame, such as a ceramic or porcelain material.

The electrode 80 preferably includes a shroud 87, for example to cover the mechanical socket, although this is not required. The shroud 87 may be formed of a metal, such as aluminum or stainless steel, that can tolerate heat and resist corrosion. The shroud 87 is preferably electrically isolated from the first electrical connector 84, the second electrical connector 83, the upper conductive disc 92 and lower conductive disc 94 of the head 90.

The electrode 80 preferably includes a spacer portion 88 between the shroud 87 and the lower conductive disc 94 of the head 90. The spacer portion 88 is preferably formed as an integral portion of the shaft 82, of the same non-conductive and heat-tolerant materials as the shaft 82.

Figure 15:
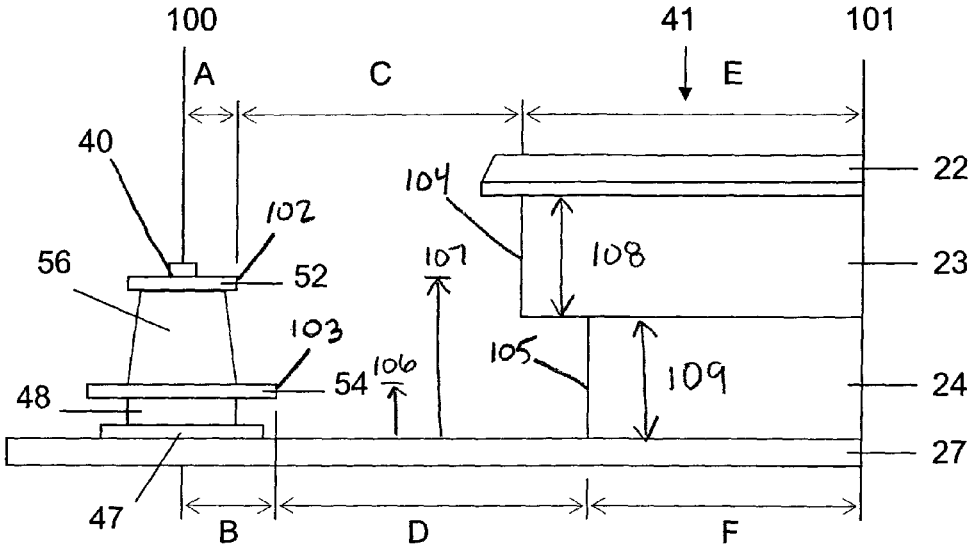
FIG. 15 is a cross-section of the burner assembly of FIG. 6 taken along the line 15-15 thereof.
Figure 16:
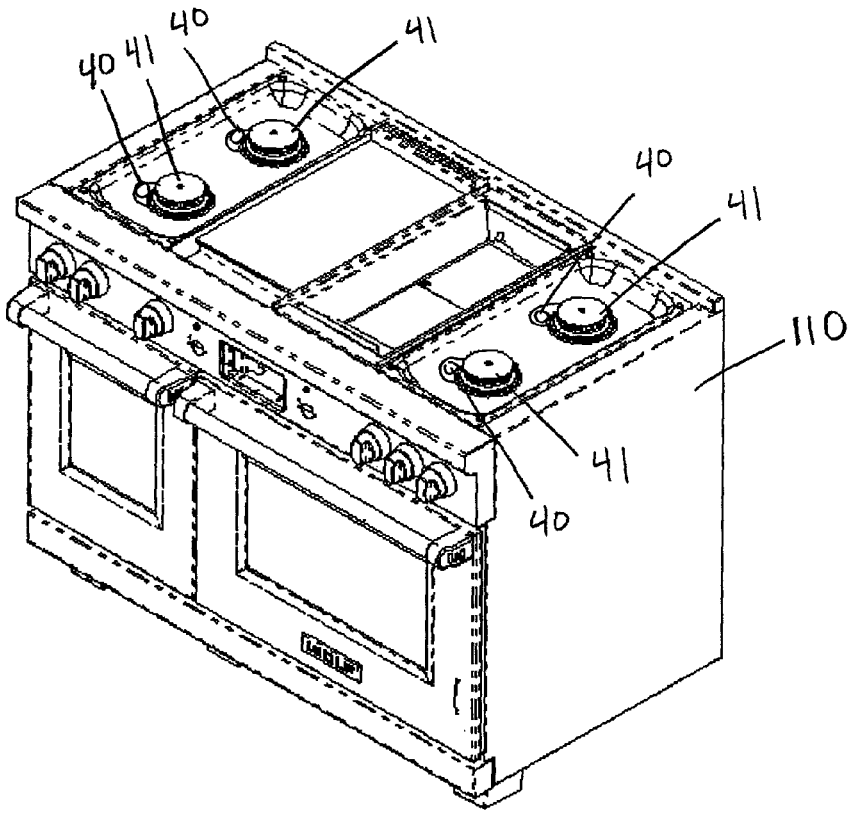
FIG. 16 is a perspective view of a cooking appliance according to another aspect of the invention with a combined igniter and flame sense electrode and a dual stage stacked gas burner.

FIG. 15 is a cross-section of the burner assembly of FIG. 6, illustrating the relative horizontal and vertical positions (not to scale) of an electrode 40 according to the invention alongside an exemplary dual stage stacked gas burner 22.

The distance labeled A in FIG. 15 is the horizontal distance between the central axis 100 of the electrode 40 and the point 102 on the upper conductive disc 52 that is nearest to the main burner 23. If the upper conductive disc 52 is formed as a circle, A is the radius of the circle. The distance labeled B in FIG. 15 is the horizontal distance between the central axis 100 of the electrode 40 and the point 103 on the lower conductive disc 54 that is nearest to the simmer burner 24.

The distance labeled C in FIG. 15 is the horizontal distance between the nearest point 104 on the main burner 23 to point 102 on the upper disc 52. The distance labeled D in FIG. 15 is the horizontal distance between the nearest point 105 on the simmer burner 24 to point 103 on the lower disc 54.

The distance labeled E in FIG. 15 is the horizontal distance between the central axis 101 of the main burner 23 and the point 104 on the main burner 23 that is nearest to the upper conductive disc 52. If the main burner is formed as a circle, E is the radius of the circle. The distance labeled F in FIG. 15 is the horizontal distance between the central axis 101 of the simmer burner 24 and the point 105 on the simmer burner 24 that is nearest to the lower conductive disc 54.

As shown in FIG. 15, the vertical position 106 of the lower conductive disc 54 is preferably near the center of the vertical extent 109 of the simmer burner 24. Similarly, the vertical position 107 of the upper conductive disc 52 is preferably near the center of the vertical extent 108 of the main burner 23.

FIG. 14 shows a cooking appliance according to the invention with a combined igniter and flame sense electrode and a dual stage stacked gas burner. The cooking appliance 110 includes a total of four exemplary dual stage stacked gas burner assemblies 41, each burner assembly including an electrode 40 according to the invention. However, this is not required, and an appliance according to the invention may include a greater or a lesser number of dual stage gas burner assemblies according to the invention.

It is important to note that the construction and arrangement of the elements of the dual disc electrode and burner system as shown in the preferred and other exemplary embodiments discussed herein are illustrative only. Those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims.

For example, while the components of the disclosed embodiments may include a dual disc electrode, a dual stage gas burner, and an appliance, the features of the disclosed embodiments have a much wider applicability. For example, the dual disc electrode design is adaptable in other settings where dual stage gas burners may be found, such as residential heating, industrial dryers or heaters, gas dryers for clothing, or water heaters.

In the exemplary embodiments, the dual disc electrode includes portions, such as the upper and lower conductive discs and the middle portion of the head, which are approximately annular (ring) in shape. However, these portions of the dual disc electrode are not necessarily annular, and other shapes could be used. For example, the upper and lower conductive discs could be triangular or square in shape. Thus, the term "disc" in the claims of this application means any structure extending from the axis of the electrode toward the central axis of the gas burner, whether or not that structure is flat, elongated, or convex, whether or not that structure is ring-shaped or not, and whether or not that structure is symmetric about the axis of the electrode.

An electrode, gas burner assembly, or appliance according to the invention can be used with, or include, a variety of different gas burners. For example, the invention can be used with dual stage burners where the individual burners are not necessarily ring-shaped, coaxial, or symmetric about the central axis of the gas burner.

Further, the invention can be used with a single stage burner, to allow reliable ignition and flame detection for a wider range of flame levels from the single stage burner. In other words, the invention can extend the effective operating range of a single stage burner—the so-called "turndown ratio" of the burner. For example, a single stage burner assembly that can reliably operate between 15,000 BTU/hr and 500 BTU/hr has a turndown ratio of 30:1.

With a wide turndown ratio, the vertical positions and horizontal reaches of the maximum and minimum flame levels will differ. At high flame outputs, the flame will be relatively long whereby it will mainly strike the upper portion of an electrode according to the invention. At low flame outputs, the flame will be relatively short and close to the burner whereby it will mainly strike the lower portion of an electrode according to the invention. Thus, a single stage burner can also be used with an electrode according to the invention, for example to extend the turndown ratio of the single stage burner.

Similarly, although the exemplary embodiments of FIGS. 6-14 show dual disc electrodes that include an upper conductive disc, a tapered middle portion, and a lower conductive disc each having a different radius, this is not necessary for an electrode according to the invention. For example, an electrode according to the invention could be formed as a truncated cone shape, where the radius of the middle section changes linearly from the upper conductive disc to the lower conductive disc. Similarly, it is not necessary that the middle portion is tapered, and it may be cylindrical, concave, or convex."

An electrode according to the invention could also be formed using an upper conductive disc, a middle portion, and a lower conductive disc where two or more of the three components might have the same radius. For example, the radius of the middle portion and the upper conductive disc might be the same, with the lower conductive disk having a larger radius, whereby such an electrode would resemble a "top hat." Similarly, the radius of the middle portion and the lower conductive disc might be the same, with the upper conductive disk larger, whereby such an electrode would resemble an inverted hat.

The particular materials used to construct the exemplary embodiments are also illustrative. For example, although the electrically conductive components of the dual disc electrode are preferably made of metal, and the non-conductive components of the dual disc electrode are preferably made of a heat resistant porcelain or ceramic, other suitable materials could be used. All such modifications, to materials or otherwise, are intended to be included within the scope of the present invention as defined in the appended claims.

The order or sequence of any process or method steps may be varied or re-sequenced according to alternative embodiments. Other substitutions, modifications, changes and/or omissions may be made in the design, operating conditions and arrangement of the preferred and other exemplary embodiments without departing from the spirit of the present invention as expressed in the appended claims.

The components of the dual disc electrode, dual stage burner, and appliance may be mounted to each other in a variety of ways as known to those skilled in the art. As used in this disclosure, the term mount includes join, unite, connect, associate, hang, hold, affix, attach, fasten, bind, paste, secure, bolt, screw, rivet, solder, weld, and other like terms. The term cover includes envelop, overlay, and other like terms.

It is understood that the invention is not confined to the embodiments set forth herein as illustrative, but embraces all such forms thereof that come within the scope of the following claims.

What is claimed is:

1. A gas burner assembly comprising:

a first burner including a first as port;

a second burner including a second gas port, wherein the second burner is stacked with the first burner; and an electrode comprising:

a non-conductive shaft;

a first conductive element mounted on the non-conductive shaft;

a second conductive element mounted on the non-conductive shaft; and an electrical connector, wherein the first conductive element and the second conductive element are both electrically connected to the electrical connector;

wherein the electrode is configured to generate a spark between at least one of the first conductive element and the first burner or the second conductive element and the second burner.

2. The gas burner assembly of claim 1, further comprising a central conductive portion between the first conductive element and the second conductive element, wherein the first conductive element, the second conductive element, the central conductive portion, and the electrical connector are electrically connected together.

3. The gas burner assembly of claim 2, wherein the first conductive element is annular in shape and formed of metal, and wherein the second conductive element is annular in shape and formed of metal.

4. The gas burner assembly of claim 1, further comprising a central nonconductive portion between the first conductive element and the second conductive element.

5. The gas burner assembly of claim 4, wherein the first conductive element is annular in shape and formed of metal, and wherein the second conductive element is annular in shape and formed of metal.

6. The gas burner assembly of claim 1, wherein the first conductive element is annular in shape and formed of metal, and wherein the second conductive element is annular in shape and formed of metal.

7. A gas burner assembly, comprising a first burner including a first gas port in a first surface of the first burner;

a second burner including a second gas port in a second surface of the second burner, wherein the second burner is stacked with the first burner in a first direction so that the first gas port and the second gas port open in a second direction generally perpendicular to the first direction; and an electrode that includes a non-conductive support member;

a first conductive element mounted on the support member and positioned closer to the first gas port than to the second gas port;

a second conductive element mounted on the support member and positioned closer to the second gas port than to the first gas port; and an electrical connector, wherein the first conductive element and the second conductive element are both electrically connected to the electrical connector.

8. The gas burner assembly of claim 7, wherein the first conductive element is annular in shape and formed of metal, and wherein the second conductive element is annular in shape and formed of metal.

9. The gas burner assembly of claim 7, wherein at least a portion of the first conductive element is positioned relative to the first gas port of the first burner to form a first spark gap therebetween in the second direction, and wherein at least a portion of the second conductive element is positioned relative to the second gas port of the second burner to form a second spark gap therebetween in the second direction.

10. The gas burner assembly of claim 9, wherein the first spark gap is between 1 and 5 mm in the second direction, and wherein the second spark gap is between 1 and 5 mm in the second direction.

11. The gas burner assembly of claim 7, wherein the first burner is a main burner, and wherein the second burner is a simmer burner.

12. The gas burner assembly of claim 7, wherein the first burner is a main burner, wherein the second burner is a simmer burner, and wherein the first burner is stacked on top of the second burner in the first direction.

13. The gas burner assembly of claim 7, wherein the first burner is a main burner, wherein the second burner is a simmer burner, and wherein the second burner is stacked on top of the first burner in the first direction.

14. The gas burner assembly of claim 7, further comprising a central conductive portion between the first conductive element and the second conductive element, wherein the first conductive element, the second conductive element, the central conductive portion, and an electrical connector of the one or more electrical connectors are connected together.

15. The gas burner assembly of claim 14, wherein the first conductive element is annular in shape and formed of metal, and wherein the second conductive element is annular in shape and formed of metal.

16. The gas burner assembly of claim 7, further comprising a central nonconductive portion between the first conductive element and the second conductive element.

17. The gas burner assembly of claim 16, wherein the first conductive element is annular in shape and formed of metal, and wherein the second conductive element is annular in shape and formed of metal.

18. The gas burner assembly of claim 7, wherein the electrode further comprises a central conductive portion between the first conductive element and the second conductive element, and further wherein the first conductive element, the second conductive element, and the central conductive portion are integrally formed together.

19. A gas appliance, comprising:

one or more gas burner assemblies, each gas burner assembly including a first burner including a first gas port in a first surface of the first burner;

a second burner including a second gas port in a second surface of the second burner, wherein the second burner is stacked with the first burner in a first direction so that the first gas port and the second gas port open in a second direction generally perpendicular to the first direction; and at least one electrode, the electrode including a non-conductive support member;

a first conductive element mounted on the support member and positioned closer to the first gas port than to the second gas port;

a second conductive element mounted on the support member and positioned closer to the second gas port than to the first gas port; and an electrical connector, wherein the first conductive element and the second conductive element are both electrically connected to the electrical connector.

20. The gas appliance of claim 19, wherein the first conductive element is annular in shape and formed of metal, and wherein the second conductive element is annular in shape and formed of metal.

21. The gas appliance of claim 19, wherein at least a portion of the first conductive element is positioned relative to the first gas port of the first burner to form a first spark gap therebetween in the second direction, and wherein at least a portion of the second conductive element is positioned relative to the second gas port of the second burner to form a second spark gap therebetween in the second direction.

22. The gas appliance of claim 19, wherein the first spark gap is between 1 and 5 mm in the second direction, and wherein the second spark gap is between 1 and 5 mm in the second direction.

23. The gas appliance of claim 19, wherein the appliance is a cooking appliance, wherein the first burner is a main burner, and wherein the second burner is a simmer burner.

24. The gas appliance of claim 19, wherein the first burner is a main burner, wherein the second burner is a simmer burner, and wherein the first burner is stacked on top of the second burner in the first direction.

25. The gas appliance of claim 19, wherein the first burner is a main burner, wherein the second burner is a simmer burner, and wherein the second burner is stacked on top of the first burner in the first direction.

26. The gas appliance of claim 19, further comprising a central conductive portion between the first conductive element and the second conductive element, wherein the first conductive element, the second conductive element, the central conductive portion, and an electrical connector of the one or more electrical connectors are connected together.

27. The gas appliance of claim 26, wherein the first conductive element is annular in shape and formed of metal, and wherein the second conductive element is annular in shape and formed of metal.

28. The gas appliance of claim 19, further comprising a central nonconductive portion between the first conductive element and the second conductive element.

29. The gas appliance of claim 19, wherein the electrode further comprises a central conductive portion between the first conductive element and the second conductive element, and further wherein the first conductive element, the second conductive element, and the central conductive portion are integrally formed together.

30. The gas appliance of claim 19, further comprising a central conductive portion between the first conductive element and the second conductive element, wherein the first conductive element, the second conductive element, the central conductive portion, and the electrical connector are connected together.

31. A gas burner assembly comprising:

a first burner including a first gas port, a second burner including a second gas port, wherein the second burner is stacked with the first burner; and an electrode comprising:

a non-conductive shaft;

a first conductive element mounted on the non-conductive shaft;

a second conductive element mounted on the non-conductive shaft;

a first electrical connector;

a second electrical connector; and wherein the first conductive element is electrically connected to the first electrical connector and the second conductive element is electrically connected to the second electrical connector, and further wherein the first conductive element is configured to generate a first spark within a vicinity of the first gas port of the first burner under control of the first electrical connector and the second conductive element is configured to generate a second spark within a vicinity of the second gas port of the second burner under control of the second electrical connector.

32. The gas burner assembly of claim 31, wherein the first conductive element is annular in shape and formed of metal, and wherein the second conductive element is annular in shape and formed of metal.

33. The gas burner assembly of claim 31, further comprising a central nonconductive portion between the first conductive element and the second conductive element.

34. The gas burner assembly of claim 31, wherein the first conductive element is electrically isolated from the second conductive element.

35. A gas burner assembly, comprising a gas burner including a first stage burner adapted to produce a high level flame extending into a high flame region and a second stage burner adapted to produce a low level flame extending into a low flame region, and an electrode that includes a non-conductive support member;

a first conductive element mounted on the non-conductive support member;

a second conductive element mounted on the non-conductive support member;

a first electrical connector;

a second electrical connector; and wherein the first conductive element is electrically connected to the first electrical connector and the second conductive element is electrically connected to the second electrical connector, and further wherein the first conductive element is configured to generate a first spark corresponding to the first stage burner under control of the first electrical connector and the second conductive element is configured to generate a second spark corresponding to the second stage burner under control of the second electrical connector.

36. The gas burner assembly of claim 35, further comprising a central nonconductive portion between the first conductive element and the second conductive element.

37. The gas burner assembly of claim 35, wherein the first conductive element is electrically isolated from the second conductive element.

38. A gas appliance, comprising one or more gas burner assemblies, wherein at least one of the one or more gas burner assemblies comprises a first stage burner adapted to produce a high level flame extending into a high flame region and a second stage burner adapted to produce a low level flame extending into a low flame region; and at least one electrode, the electrode including a non-conductive support member;

a first conductive element mounted on the non-conductive support member;

a second conductive element mounted on the non-conductive support member;

a first electrical connector;

a second electrical connector; and wherein the first conductive element is electrically connected to the first electrical connector and the second conductive element is electrically connected to the second electrical connector, and further wherein the first conductive element is configured to generate a first spark corresponding to the first stage burner under control of the first electrical connector and the second conductive element is configured to generate a second spark corresponding to the second stage burner under control of the second electrical connector.

39. The gas appliance of claim 38, wherein the first conductive element is annular in shape and formed of metal, and wherein the second conductive element is annular in shape and formed of metal.

40. The gas appliance of claim 38, further comprising a central nonconductive portion between the first conductive element and the second conductive element.

41. The gas appliance of claim 38, wherein the first conductive element is electrically isolated from the second conductive element.

* * * * *